US006230455B1

(12) United States Patent
Arehart et al.

(10) Patent No.: US 6,230,455 B1
(45) Date of Patent: May 15, 2001

(54) HIGH IMPACT FLANGED WINDOW SCREEN

(75) Inventors: Fred B. Arehart; Glenn T. Lilie, both of Pearland, TX (US)

(73) Assignee: CPI Group, Inc., Pearland, TX (US)

( * ) Notice: Subject to any disclaimer, the term of this patent is extended or adjusted under 35 U.S.C. 154(b) by 0 days.

(21) Appl. No.: 09/432,336

(22) Filed: Nov. 2, 1999

(51) Int. Cl.[7] ..... E06B 3/26; A47G 5/00
(52) U.S. Cl. ..... 52/202; 160/379; 49/50
(58) Field of Search ..... 52/202, 203, 208, 52/474; 49/50, 57; 160/369, 379

(56) References Cited

U.S. PATENT DOCUMENTS 5,141,046 * 8/1992 Duncan ..... 160/379
5,603,190 * 2/1997 Sanford ..... 52/202
5,720,137 * 2/1998 Rodriquez ..... 52/202
5,852,903 * 12/1998 Astrizky ..... 52/202
6,122,868 * 9/2000 Knezevich ..... 52/202

* cited by examiner

*Primary Examiner*—Christopher T. Kent
*Assistant Examiner*—Jennifer I. Thissell
(74) *Attorney, Agent, or Firm*—James E. Bradley; Bracewell & Patterson, L.L.P.

(57) ABSTRACT

A high strength window screen frame that includes an extruded metal frame that surrounds a window opening in a building. The frame defines an opening. A screen plate portion of the extruded metal frame is provided on the frame proximate the opening. A flange portion of the extruded metal frame is provided on an outside of the frame away from the opening. A beveled surface on the flanged portion is provided to improve the appearance of the metal frame. A screen plate stiffener is removably affixed to a back side of the extruded metal frame to secure a screen to the frame. Heavy duty mesh screen is preferably used with a high strength window screen frame of the invention. The flanged portion of the window screen frame is bolted to an exterior wall surrounding a window opening of a structure.

13 Claims, 3 Drawing Sheets

HIGH IMPACT FLANGED WINDOW SCREEN

TECHNICAL FIELD

The present invention relates to a window screen. More particularly, the invention relates to a window screen having strong components that may be used as an impact protective system, particularly for window protection from impacts due to debris from wind storms, hurricanes, tornados and the like.

BACKGROUND OF THE INVENTION

Windows are typically provided in structures such as residential homes, schools, office buildings and other buildings designed primarily for human occupation. Often times it is desirable to allow for the windows to be opened so that outside air may enter the building. Screens are typically provided on such window openings so that air may pass through the window opening, but undesirable objects such as insects are kept outside of the building. Most prior art screens are made of aluminum mesh and do not have adequate strength to protect against window breakage. Also, whether the window can open or not, prior art screens are known that can protect window glass from damage, if strong enough.

In areas that are subject to high winds, such as areas that may experience hurricanes or tornados, it is desirable to provide a screen that will protect window glass from flying debris. Buildings that are prone to be vandalized, such as schools and low income housing, use screens to protect against glass breakage. One prior art screen that provides protection against glass breakage comprises stainless steel mesh within an aluminum frame. In the prior art, the screen is typically sized to fit within a wall opening and secured by screws to the frame of the window. The screen will then be recessed from the building exterior wall.

SUMMARY OF THE INVENTION

The invention of the application is a high strength window screen frame adapted to fit flush on an extension wall of a building over a window. The window screen frame includes an extruded metal frame that defines an opening for receiving mesh. A screen plate portion of the extruded metal frame is provided on the frame proximate the opening. A flange portion of the extruded metal frame is provided on an outside of the frame away from the opening. A beveled surface, or alternatively, a rectangular edge for the flanged portion may be provided. A screen plate stiffener is removably affixed to a back side of the extruded metal frame to secure a screen within the high strength window screen frame. Heavy duty mesh screen is preferably used with the high strength window screen frame of the invention. The flanged portion of the window screen frame is screwed by fasteners to an exterior wall surrounding a window opening of a structure.

DETAILED DESCRIPTION OF THE INVENTION

Figure 2:
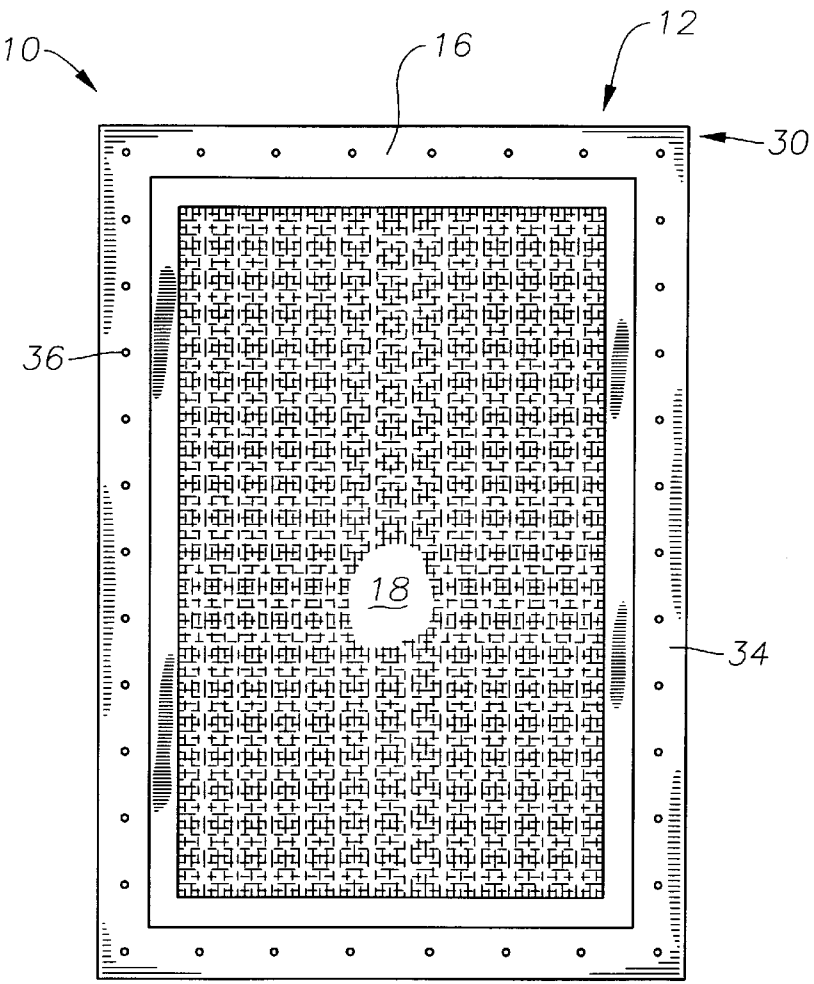
FIG. 2 is a back view of a high impact flanged window screen frame of the invention.
Figure 1:
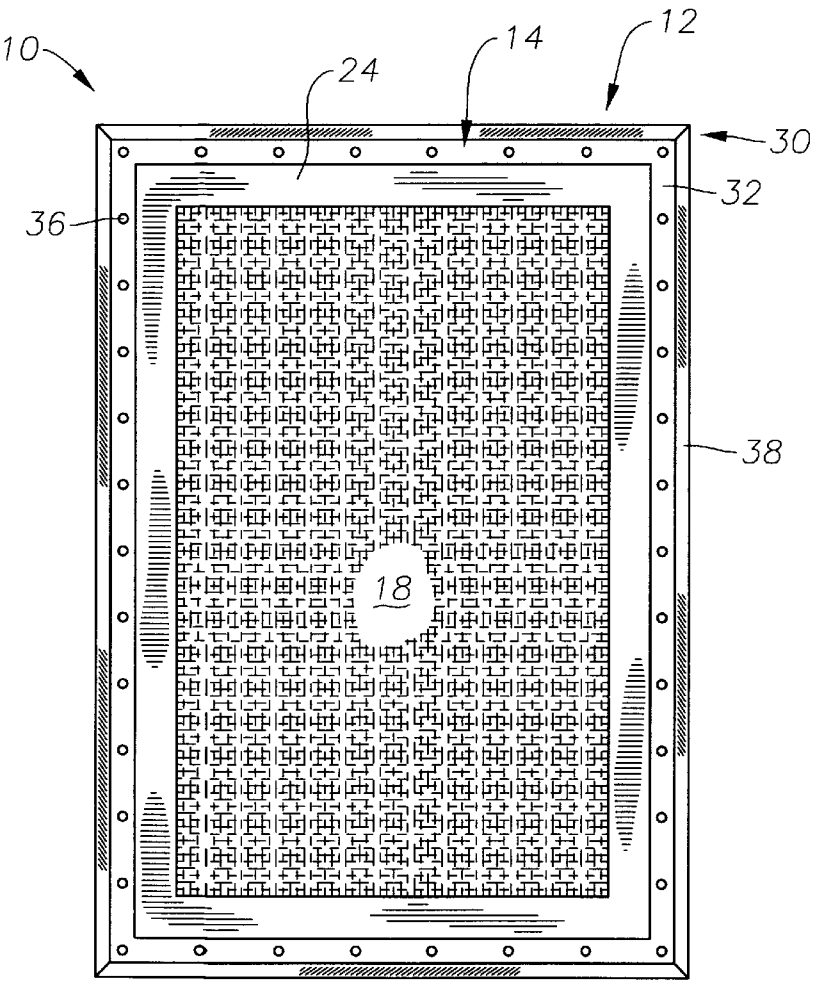
FIG. 1 is a front view of a high impact flanged window screen frame of the invention.

A high strength window screen frame 10 includes an extruded metal frame 12. Preferably, the extruded metal frame is a hollow extruded aluminum frame. Variations may exist in the cross-sectional configuration, depending upon building materials and the type of window used in conjunction with the high strength window frame 10. Extruded metal frame 12 has a front 14, a back 16 and defines an opening 18. Extruded metal frame 12 is designed to be used in conjunction with a window opening of a structure.

An inner or screen plate portion 20 (FIGS. 3, 4 and 5) is provided on an inside of extruded metal frame 12 nearest opening 18. Screen plate portion 20 has a front screen plate face 24 (FIGS. 1, 3, 4 and 5), a rear screen plate face 26 (FIGS. 2, 4 and 5) and an inside surface 28. A flange portion 30 is provided on an outside of extruded metal frame 12 on the portion of extruded metal frame 12 away from opening 18. Flange portion 30 has a front face 32 (FIGS. 1, 3, 4 and 5), a rear flange face 34 (FIGS. 2, 4 and 5) and a plurality of holes 36 for receiving bolts therethrough. Front face 32 is parallel to and recessed from front screen plate face 24.

Figure 3:
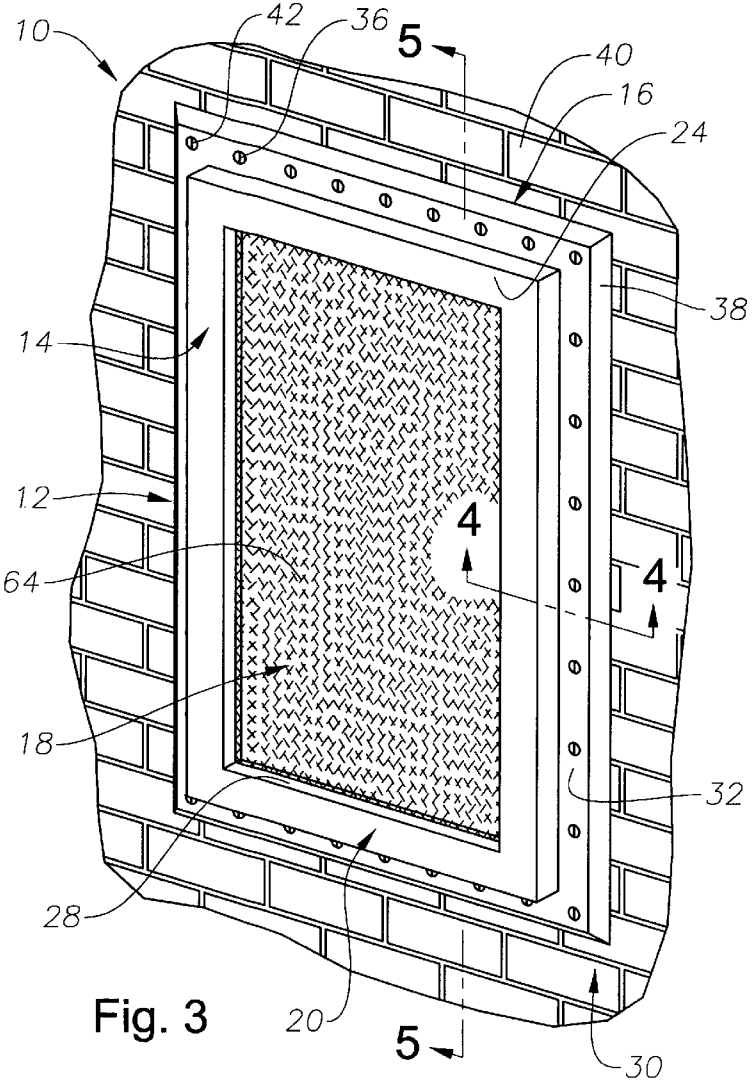
FIG. 3 is a perspective view of a high impact flanged window screen frame of the invention.
Figure 6:
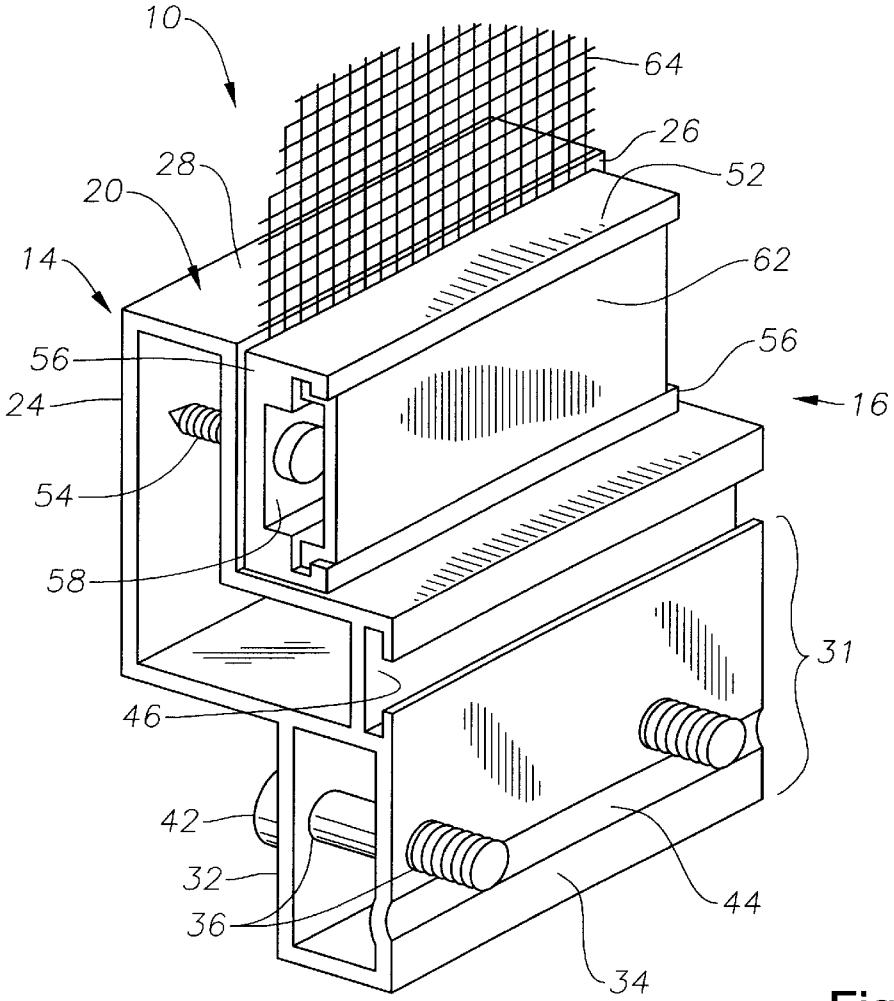
FIG. 6 is perspective cross sectional view of an alternative embodiment of the high impact flanged window screen frame of the invention.

Flange portion 30 may be provided with a beveled surface 38 (FIG. 3). Alternatively, flange portion 31 may be squared off as shown in FIG. 6. Preferably, a caulk recess 44 is provided on a rear flange face 34 of extruded metal frame 12. An insulation groove 46 may be provided on rear flange face 34 to receive a felt insulation strip that abuts wall 40.

Figure 4:
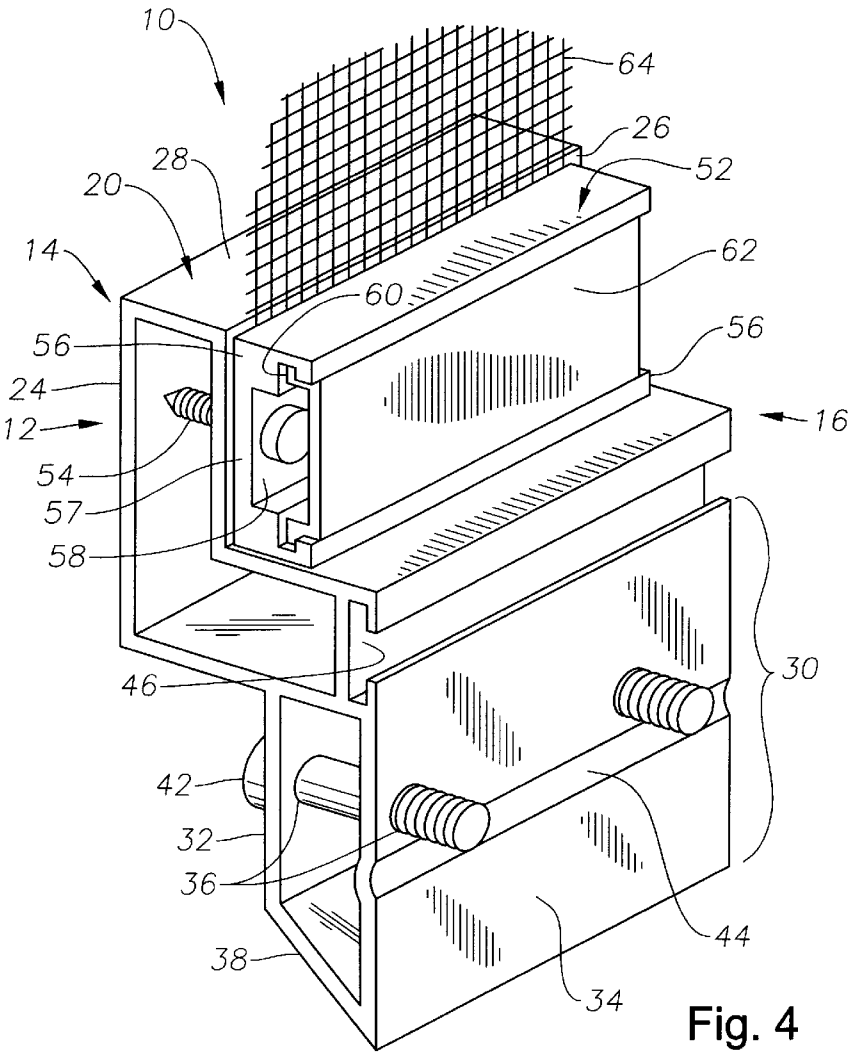
FIG. 4 is perspective cross sectional view of the high impact flanged window screen frame of the invention taken along line 4—4 of FIG. 1.

Referring now to FIGS. 4 and 6, a metal screen plate stiffener 52 is removably affixed to rear screen plate face 26 with a plurality of self-tapping sheet metal screws 54. Screen plate stiffener 52 is a channel strip, having a pair of outer rims 56 and a base 57 that define a longitudinal channel 58. An inner slot 60 is formed on an inner surface of outer rims 56. A slidable plastic cover 62 is received within interior slots 60 on the screen plate stiffener 52. Screen plate stiffener 52 is secured to the rear screen plate face 26 for securing a heavy duty mesh screen 64 (FIGS. 3 and 4).

Figure 5:
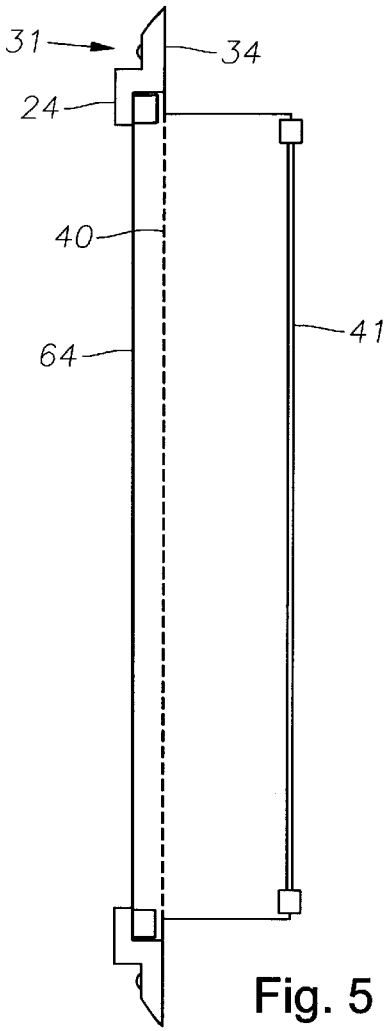
FIG. 5 is a schematic sectional view of the window screen of the invention taken along line 5—5 of FIG. 3.

In use, the high strength window screen frame 10 of the invention is positioned around an opening in wall 40 that surrounds window 41 (FIG. 5). Rear flange face 34 is designed to abut with an outer surface of a wall 40 (FIGS. 3 and 5), which surrounds recessed window 41. Screws 42 (FIGS. 3, 4 and 5)secure extruded metal frame 12 to wall 40. Window 41 is recessed from mesh screen 64 a considerable distance. The distance equals the dimension from window 41 to the exterior of the wall, plus the distance from face 34 to mesh 64. Flange portion 30 may be viewed from outside of the structure once window screen frame 10 is installed. Bolts 42 are inserted into holes 36 in flange portion 30 to secure the high strength window screen frame 10 to the structure.

The invention has numerous advantages. The high strength screen window frame of the invention has an attractive appearance. Therefore, the window screen frame may be secured to an outside surface of a building wall. The high strength construction of the frame, when used in conjunction with heavy steel mesh screen, provides an impact protective system that protects window glass from flying debris. Additionally, the high strength window screen frame of the invention is less expensive than alternative impact protective systems, such as the use of safety glass. Further, alternatives such as burglar bars or boarding up windows is unattractive and inconvenient. An additional advantage is that the high strength window screen frame of the invention may be easily installed on existing structures. The offset between the window and the screen enhances impact protection.

While the invention has been shown in only one of its forms, it should be apparent to those skilled in the art that it is not so limited, but is susceptible to various changes without departing from the scope of the invention.

What is claimed is:

1. A window screen comprising:

an extruded metal frame having an inner portion with an inside edge defining an opening, the inner portion having a front face and a back;

a mesh secured to the inner portion of the frame; and a flange portion integrally formed on an outside of said inner portion of said frame, the flange portion having a front face that is positioned outward from the inner portion and offset rearward from the front face of the inner portion, the flange portion having a back that is adapted to abut against an exterior surface of a structure wall.

2. The window screen according to claim 1 wherein:

said flange portion has a beveled surface extending from an outer edge of said front face of said flange portion outwardly to an outer edge of said flange portion.

3. The window screen according to claim 1 wherein:

said back of said flange portion is offset rearward from said back of said inner portion.

4. The window screen according to claim 1 wherein:

said back of said flange portion has a caulk groove formed thereon.

5. The window screen according to claim 1 wherein:

said inner portion and said flange portion are hollow.

6. The window screen according to claim 1 wherein:

said frame further comprises a shoulder on an inside of said frame proximate said opening and facing rearward;

a screen plate stiffener strip affixed to said shoulder by fasteners, with edges of the mesh sandwiched between said stiffener strip and said shoulder.

7. A window screen comprising:

an extruded metal frame having an inner portion with an inner edge defining an opening, the inner portion having a front wall and a back wall, said frame further comprising a shoulder on an inside of said frame proximate said opening and facing rearward; and a mesh secured to the inner portion of the frame;

a flange portion integrally formed on an outside of said inner portion of said frame having a front wall and a back wall that is adapted to abut against an exterior surface of a structure wall;

a screen plate stiffener removably affixed to said shoulder by fasteners with edges of the mesh sandwiched between the screen plate stiffener and the shoulder, said screen plate stiffener having a base and a pair of outer rims defining a longitudinal channel, wherein at least a portion of said outer rims proximate said base have a greater thickness than said base so that said screen plate stiffener acts as a supporting member.

8. The window screen frame according to claim 7 further comprising:

interior slots formed on an inner surface of said outer rims.

9. The window screen frame according to claim 7 further comprising:

interior slots formed on an inner surface of said outer rims; and a cover slidably received within said interior slots of said outer rims.

10. The window screen frame according to claim 7 wherein:

said flange portion has a beveled surface extending from an outer edge of said front wall of said flange portion outwardly to an outer edge of said back wall of said flange portion.

11. A method of protecting a window located in an exterior wall, the window being in a plane rearward from a plane containing a face of the exterior wall, said method comprising the steps of:

providing a metal frame having a hollow inner portion with an inside edge defining an opening, a hollow flange portion having a front face positioned outward from the hollow inner portion and offset rearward from the front face of the hollow inner portion;

securing a mesh to the hollow inner portion of the frame;

abutting a back face of said flange portion of said frame against the face of the exterior wall of a structure around a window; and inserting a fastener through said flange portion and into said exterior wall.

12. A window screen comprising:

an extruded metal frame having an inner portion with an inside edge defining an opening, the inner portion having a front face and a back;

a mesh secured to the inner portion of the frame;

a flange portion integrally formed on an outside of said inner portion of said frame, the flange portion having a front face that is offset rearward from the front face of the inner portion and a back that is adapted to abut against an exterior surface of a structure wall; and said frame further comprises a shoulder on an inside of said frame proximate said opening and facing rearward; and a screen plate stiffener strip removable affixed to said shoulder by fasteners with edges of the mesh sandwiched between the stiffener strip and the shoulder, said screen plate stiffener strip having a base, a pair of outer rims defining a longitudinal channel, and interior slots formed on an inner surface of said outer rims, wherein at least a portion of said outer rims proximate said base have a greater thickness than said base so that said screen plate stiffener strip acts as a supporting member.

13. A window screen comprising:

an extruded metal frame having an inner portion with an inside edge defining an opening, the inner portion having a front face and a back;

a mesh secured to the inner portion of the frame;

a flange portion integrally formed on an outside of said inner portion of said frame, the flange portion having a front face that is offset rearward from the front face of the inner portion and a back that is adapted to abut against an exterior surface of a structure wall; and said frame further comprises a shoulder on an inside of said frame proximate said opening and facing rearward; and a screen plate stiffener strip removable affixed to said shoulder by fasteners with edges of the mesh sandwiched between the stiffener strip and the inner portion of the frame, said screen plate stiffener strip having a pair of outer rims defining a longitudinal channel, and interior slots formed on an inner surface of said outer rims; and a slidable cover slidably received within said interior slots of said outer rims.

* * * * *